US006638141B2

(12) United States Patent
Ide

(10) Patent No.: US 6,638,141 B2
(45) Date of Patent: Oct. 28, 2003

(54) METHOD AND APPARATUS FOR CHEMICAL-MECHANICAL POLISHING

(75) Inventor: Shigeaki Ide, Kumamoto (JP)

(73) Assignee: NEC Electronics Corporation, Kawasaki (JP)

( * ) Notice: Subject to any disclaimer, the term of this patent is extended or adjusted under 35 U.S.C. 154(b) by 0 days.

(21) Appl. No.: 10/190,016

(22) Filed: Jul. 5, 2002

(65) Prior Publication Data

US 2003/0008600 A1 Jan. 9, 2003

(30) Foreign Application Priority Data

Jul. 6, 2001 (JP) ..... 2001-206939

(51) Int. Cl.[7] ..... B24B 49/00

(52) U.S. Cl. ..... 451/7; 491/5; 491/6; 491/41; 491/53; 491/285; 491/286; 491/287; 491/288

(58) Field of Search ..... 451/5, 6, 7, 41, 451/53, 285, 286, 287, 288

(56) References Cited

U.S. PATENT DOCUMENTS 5,842,909 A * 12/1998 Sandhu et al. ..... 451/7

6,379,222 B2 * 4/2002 Wise et al. ..... 451/41

FOREIGN PATENT DOCUMENTS

| | | |
|---|---|---|
| JP | 11-033897 | 2/1999 |
| JP | 11-121409 | 4/1999 |

* cited by examiner

*Primary Examiner*—Joseph J. Hail, III
*Assistant Examiner*—Shantese McDonald
(74) *Attorney, Agent, or Firm*—Katten Muchin Zavis Rosenman

(57) ABSTRACT

A polishing apparatus for CMP is provided. Heating means heats the substrate held by the holder. Temperature detecting means detects temperature of the heating means. Temperature compensating means sets temperature compensation values in such a way that a polishing rate is approximately uniform over a whole polishing surface of a polishing film. The polishing film is formed on the substrate. The heating means is controlled in such a way that the temperature detected by the temperature detecting means corresponds to the temperature compensation values. The substrate is heated by the heating means while controlling the heating means with the controller within a polishing period of the film. The heating means may comprise heaters arranged to cover the substrate and controlled by a controller.

12 Claims, 5 Drawing Sheets

METHOD AND APPARATUS FOR CHEMICAL-MECHANICAL POLISHING

BACKGROUND OF THE INVENTION

1. Field of the Invention

The present invention relates generally to the chemical-mechanical polishing (CMP) technique. More particularly, the invention relates to a CMP method and a CMP apparatus which are preferably used for the planarization processes for substrates or wafer in semiconductor device fabrication.

2. Description of the Related Art

Recently, the CMP process has been attracting our attention as one of the planarization techniques in semiconductor device fabrication field. This is because the CMP process makes it possible to planarize globally a deposited film of films over a whole semiconductor wafer or substrate, which has been difficult to be realized with the use of any other conventional planarization techniques, such as the etch back process. The planarization of deposited film(s) is an essential process to enhance the integration scale (i.e., density) and miniaturization of semiconductor integrated circuit devices. Thus, it is said that the CMP process is one of the most important techniques.

FIG. 1 shows schematically a prior-art polishing apparatus for the CMP process.

The apparatus of FIG. 1 comprises a circular rotating platen 101 having a polishing pad 102 on its surface. The bottom of the platen 101 is fixed to a vertical rotating shaft 105. The shaft 105 is rotatable around its axis with a first driving mechanism (not shown). Thus, the platen 101 is rotatable in a horizontal plane by way of the shaft 105. The pad 102 is rotatable along with the platen 101.

A slurry supply tube 103 is mounted at a specific position over the platen 101 in such a way that the outlet of the tube 103 is oriented toward the pad 102. The tube 103 is used to supply a polishing slurry 104 onto the pad 102 in the form of drops.

A substrate holder 110 is movably provided over the platen 101 to hold or carry a substrate (e.g., a semiconductor wafer) 106 having a target film (not shown) to be polished on its surface. The holder 110 has a cylindrical body 111 with an inverted U-shaped cross section. The body 111 has a cylindrical inner space.

A vertical spindle 112 is fixed to the top of the substrate holder 111. The spindle 112 is rotatable around its axis with a second driving mechanism (not shown). Thus, the holder 101 is rotatable in a horizontal plane and movable vertically and horizontally by way of the spindle 112.

A circular plate 113 is fixed horizontally in the inner wall of the holder body 111. The plate 113 is located at an elevated position from the bottom end of the body 111 by a specific distance. A backing film 114, which is made of a resin, is attached to the lower surface of the plate 113.

The holder 110 holds or carries the substrate 106 by way of the backing film 114 and the plate 113. The holder 110 is horizontally rotatable and vertically movable with the second driving mechanism while holding the substrate 106.

Next, the operation of the prior-art polishing apparatus of FIG. 1 (i.e., the CMP process with the apparatus) is explained below.

First, a substrate 106 having a target film on its surface is held with the substrate holder 110 in such a way that the target film is oriented to the lower side. This is performed in the state where the holder 110 is sufficiently apart from the platen 101.

Next, a polishing slurry 104 is supplied onto the surface of the polishing pad 102 by way of the slurry supply tube 103 in the form of drops while rotating the platen 101 in a horizontal plane, as shown in FIG. 1. Due to the rotation of the platen 101, the slurry 104 supplied onto the pad 102 is automatically distributed uniformly on the surface of the pad 102.

Thereafter, the holder 110 is moved toward the pad 102 while rotating the holder 110 in the same direction as the rotating platen 101 until the target film (not shown) of the substrate 106 is attached to the surface of the pad 102. In this state, the surface area of the target film reacts chemically with potassium hydroxide (KOH) contained in the slurry 104, thereby forming a soft layer (not shown) on the target film. The soft layer thus formed is mechanically polished with grains contained in the slurry 104. As a result, the CMP process advances.

In this way, with the CMP process, the target film on the substrate 106 is polished by both a chemical action (formation of a soft layer) and a mechanical action (polishing with grains).

In general, the polishing rate (i.e., polishing speed) in the CMP process varies dependent upon various factors, such as the temperature of the polishing surface, the pressing force against the polishing pad 102, the backing pressure against the plate 113, the rotation speeds of the platen 101 and the holder 110, the surface roughness of the pad 102, the distribution status of the slurry 104, and the density of the grains in the slurry 104.

With the prior-art apparatus of FIG. 1, there is a problem that the polishing rate is likely to be non-uniform due to the above-describe factors in the polishing plane. For example, if the desired or designed polishing rate is 500±50 nm/min, the actual polishing rate tends to have a dispersion as much as 50 to 100 nm/min over the whole substrate 106. To avoid this problem, a variety of improvements has been made so far.

For example, the Japanese Non-Examined Patent Publication No. 11-33897 published in 1999 discloses a polishing apparatus for CMP. This apparatus comprises temperature detection means for detecting the temperature of a substrate and substrate heating means for heating a substrate, which are located in substrate holding means for holding a substrate. The substrate is heated with the substrate heating means in such a way that the in-plane temperature of the substrate is uniform. This apparatus makes it possible to uniformize the temperature as one of the factors affecting the polishing rate over the whole substrate.

The Japanese Non-Examined Patent Publication No. 11-121409 published in 1999 discloses another polishing apparatus for CMP. This apparatus comprises heaters arranged concentrically in a top ring (i.e., substrate holding means). The heat quantities from the respective heaters are adjusted to control the in-plane temperature distribution of the substrate in the radial directions. This apparatus makes it possible to control the in-plane polishing rate of a substrate.

With the prior-art apparatus of FIG. 1, as explained above, the polishing rate (i.e., the polishing speed) is likely to be non-uniform within the polishing surface. Therefore, there is a problem that a satisfactory or sufficient flatness is difficult to be realized over the whole substrate. The insufficient flatness will cause exposure error due to discrepancy in depth of focus in the lithography process and/or reliability degradation of wiring lines formed over uneven surfaces.

With the polishing apparatus disclosed by the Publication No. 11-33897, the temperature may be uniformized over the whole substrate. However, any other factors affect the polishing rate. Thus, there is a problem that satisfactory flatness of the substrate is not always formed over the whole substrate.

With the polishing apparatus disclosed by the Publication No. 11-121409, there is a problem as follows.

In general, heat is generated by friction within the polishing period to thereby raise (or fluctuate) the temperature of the polishing surface. Like this, with the apparatus of the Publication No. 11-121409, there is a possibility that temperature fluctuation of the polishing surface occurs due to friction heat within the polishing period and as a result, a desired polishing rate or speed is unable to be generated. Therefore, a problem that satisfactory flatness of the substrate is not always formed over the whole substrate occurs.

SUMMARY OF THE INVENTION

Accordingly, an object of the present invention is to provide a polishing method and a polishing apparatus for CMP that uniformize substantially the polishing rate or speed within the polishing surface of a substrate.

Another object of the present invention is to provide a polishing method and a polishing apparatus for CMP that facilitate the generation of satisfactory or improved flatness over a whole substrate.

The above objects together with others not specifically mentioned will become clear to those skilled in the art from the following description.

According to a first aspect of the invention, a polishing apparatus for CMP is provided, which comprises:

- a polishing platen rotatable around its axis, on which a polishing pad is placed on operation;
- a substrate holder for holding a substrate to be polished, the holder being rotatable around its axis and the substrate having a target film to be polished;
- heating means for heating the substrate held by the holder;
- temperature detecting means for detecting temperature of the heating means;
- temperature compensating means for setting a temperature compensation value in such a way that a polishing rate is approximately uniform over a whole polishing surface of the target film; and
- a controller for controlling the heating means in such a way that the temperature detected by the temperature detecting means corresponds to the temperature compensation value;
- wherein the substrate is heated by the heating means while controlling the heating means with the controller within a polishing period of the target film.

With the apparatus according to the first aspect of the invention, there are provided with the heating means for heating the substrate held by the holder, the temperature detecting means for detecting the temperature of the heating means, the temperature compensating means for setting the temperature compensation value in such a way that the polishing rate is approximately uniform over the whole polishing surface of the target film, and the controller for controlling the heating means in such a way that the temperature detected by the temperature detecting means corresponds to the temperature compensation value. The substrate is heated by the heating means while controlling the heating means with the controller with the controller within a polishing period of the target film.

Thus, the polishing rate or speed can be substantially uniformized within the polishing surface of the substrate.

Moreover, the heating means is controlled by the controller in such a way that the temperature detected by the temperature detecting means corresponds to the temperature compensation value. Therefore, the generation of satisfactory or improved flatness can be facilitated over the whole substrate.

In a preferred embodiment of the apparatus according to the first aspect of the invention, the temperature compensating means sets the temperature compensation value based on post-polish thickness distribution of the target film. In this embodiment, there is an additional advantage that the polishing rate can be uniformized more surely.

In another preferred embodiment of the apparatus according to the first aspect of the invention, the heating means comprises heaters arranged to cover the substrate. The heaters are controlled by the controller.

In still another preferred embodiment of the apparatus according to the first aspect of the invention, the temperature detecting means comprises temperature sensors arranged to cover the substrate. Each of the sensors detects a temperature of a corresponding one of the heaters.

According to a second aspect of the invention, a polishing method for CMP is provided, which comprises:

- providing a polishing platen rotatable around its axis, on which a polishing pad is placed on operation;
- providing a substrate holder for holding a substrate to be polished, the holder being rotatable around its axis and the substrate having a target film to be polished;
- setting a temperature compensation value in such a way that a polishing rate is approximately uniform over a whole polishing surface of the target film of the substrate; and
- pressing the substrate held by the rotating holder against the rotating pad to polish the film while heating the substrate with heating means;
- wherein the temperature of the heating means is detected by temperature detecting means;
- and wherein the heating means is controlled in such a way that the temperature detected by the temperature detecting means corresponds to the temperature compensation value.

With the method according to the second aspect of the invention, due to the same reason as described for the apparatus according to the first aspect of the invention, the same advantages as those of the apparatus of the first aspect are obtainable.

In a preferred embodiment of the method according to the second aspect of the invention, a post-polishing thickness of the target film is measured. The temperature compensation value is determined based on the post-polishing thickness thus measured.

In another preferred embodiment of the method according to the second aspect of the invention, the heating means comprises heaters arranged to cover the substrate. The heaters are controlled by a controller.

In still another preferred embodiment of the method according to the second aspect of the invention, the temperature detecting means comprises temperature sensors arranged to cover the substrate. Each of the sensors detects a temperature of a corresponding one of the heaters.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
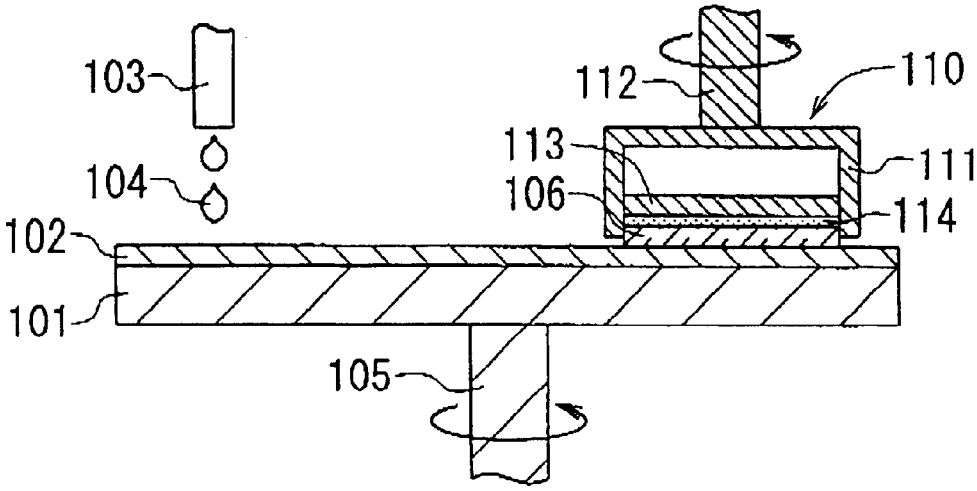
FIG. 1 PRIOR ART
FIG. 1 is a schematic cross-sectional view showing the configuration of the main part of a prior-art polishing apparatus for the CMP process.

Preferred embodiments of the present invention will be described in detail below while referring to the drawings attached.

Figure 2:
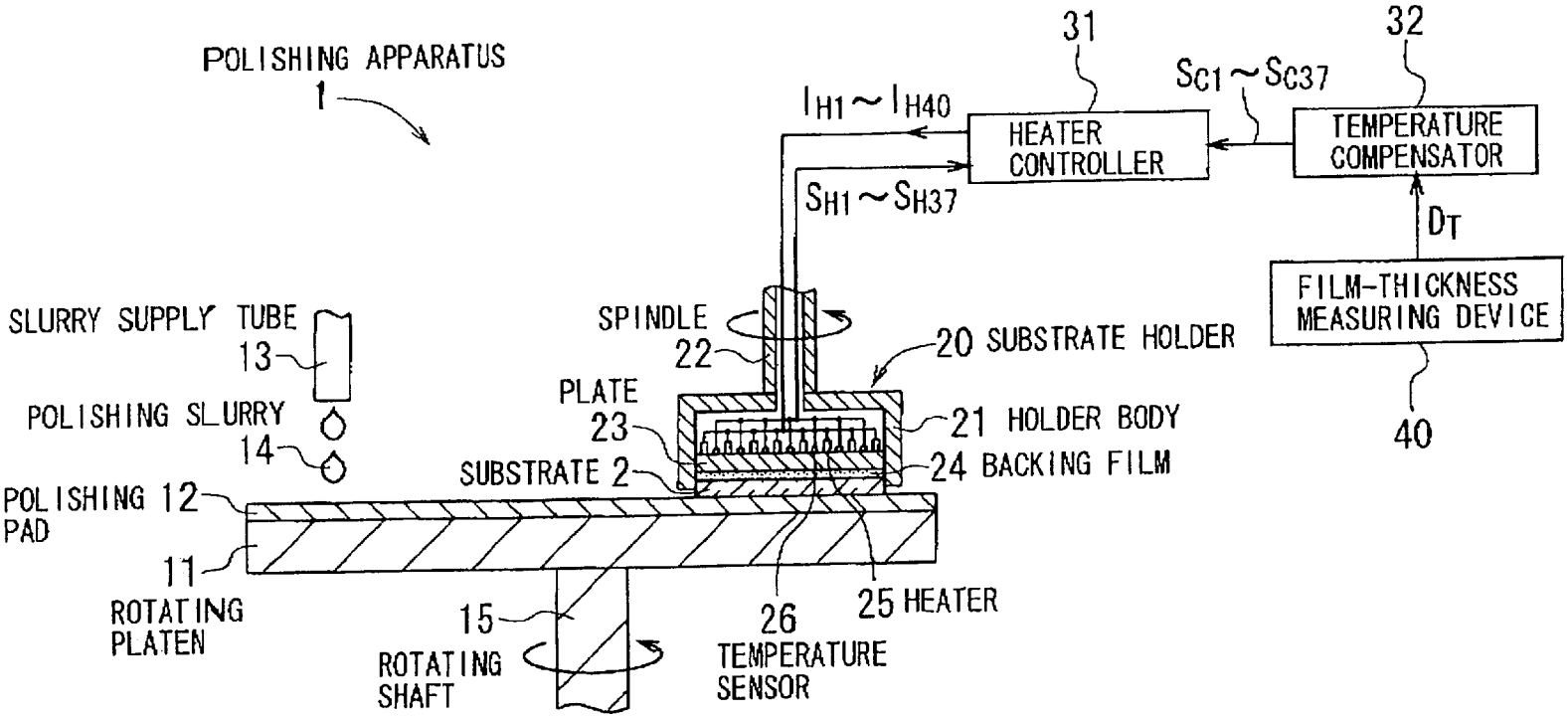
FIG. 2 is a schematic, partial cross-sectional view showing the configuration of a polishing apparatus for the CMP process according to an embodiment of the invention.

FIGS. 2 and 3 show the configuration of a polishing apparatus 1 for CMP according to an embodiment of the invention.

The apparatus 1 of FIG. 2 comprises a circular rotating platen 11 having a polishing pad 12 on its surface. The bottom of the platen 11 is fixed to a vertical rotating shaft 15. The shaft 15 is rotatable around its axis with a first driving mechanism (not shown). Thus, the platen 11 is rotatable in a horizontal plane by way of the shaft 15. The pad 12 is rotatable along with the platen 11.

A slurry supply tube 13 is mounted at a specific position over the platen 11 in such a way that the outlet of the tube 13 is oriented toward the pad 12. The tube 13 is used to supply a polishing slurry 14 onto the pad 12 in the form of drops.

A substrate holder 20 is movably provided over the platen 11 to hold or carry a substrate (e.g., a semiconductor wafer) 2 having a target film 3 to be polished on its surface. The holder 20 has a cylindrical body 21 with an inverted U-shaped cross section. The body 21 has a cylindrical inner space.

A vertical spindle 22 is fixed to the top of the substrate holder 20. The spindle 22 is rotatable around its axis with a second driving mechanism (not shown). Thus, the holder 20 is rotatable in a horizontal plane and movable vertically and horizontally by way of the spindle 22.

A circular plate 23 is fixed horizontally in the inner wall of the holder body 21. The plate 23 is located at an elevated position from the bottom end of the body 21 by a specific distance. A backing film 24, which is made of a resin, is attached to the lower surface of the plate 23.

The holder 20 holds or carries the substrate 2 by way of the backing film 24 and the plate 23 while facing the target film 3 of the substrate 2 toward the pad 12 on the platen 11. Thus, the adhesion strength of the substrate 2 to the plate 23 is enhanced and at the same time, the pressing force applied to the substrate 2 is well dispersed and uniformized over the whole substrate 2. The holder 20 is horizontally rotatable and vertically and horizontally movable with the second driving mechanism while holding the substrate 2.

Figure 3A:
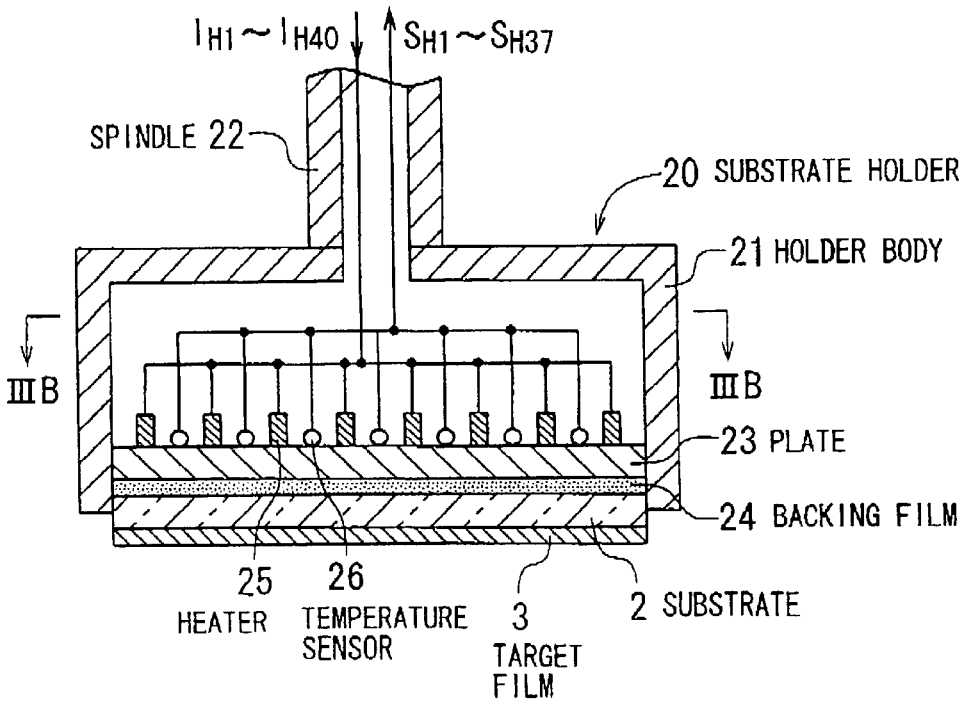
FIG. 3A is an enlarged, schematic cross-sectional view showing the detailed configuration of the substrate holder of the polishing apparatus according to the embodiment of FIG. 2.
Figure 3B:
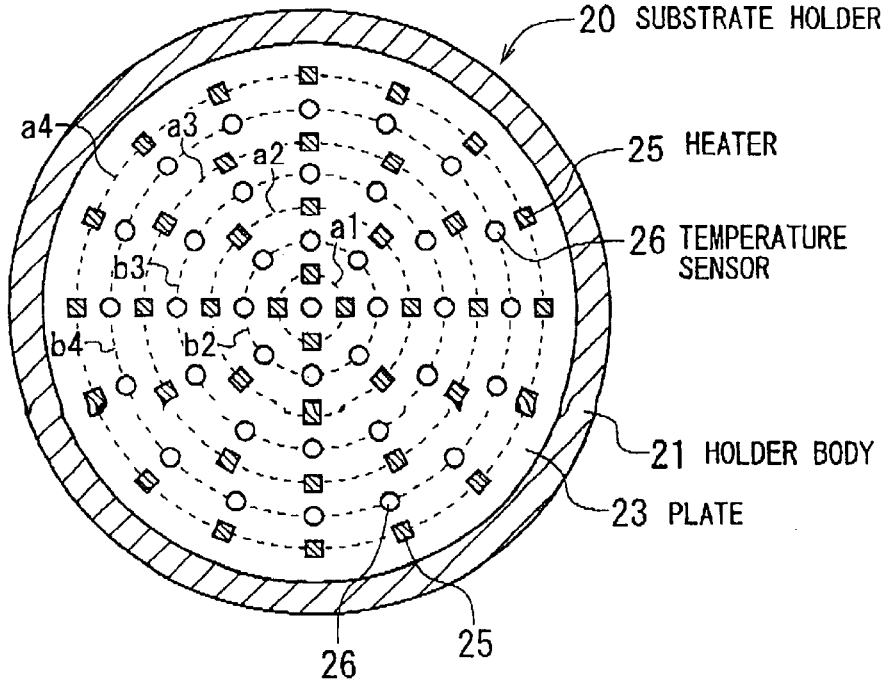
FIG. 3B is an enlarged, schematic cross-sectional view along the line IIIB—IIIB in FIG. 3A.

As clearly shown in FIGS. 3A and 3B, forty (40) heaters 25 and thirty seven (37) temperature sensors 26 are arranged on the upper surface of the plate 23 in the holder 20.

The heaters 25 are arranged along four concentric imaginary circles a1, a2, a3, and a4 having the common center c of the plate 23 and different radiuses. Specifically, four of the heaters 25 are arranged along the smallest circle a1 at equal intervals. Eight of the heaters 25 are arranged along the circle a2 whose radius is larger than the circle a1 at equal intervals. Twelve of the heaters 25 are arranged along the circle a3 whose radius is larger than the circle a2 at equal intervals. Sixteen of the heaters 25 are arranged along the circle a4 whose radius is larger than the circle a3 at equal intervals. The operation of these heaters 25 is controlled by a heater controller 31. As the heater 25, for example, a resistance heater designed to generate heat by supplying an electric current is preferably used. However, any other type of heater may be used if it can be located near the substrate 2.

The temperature sensors 26 are provided to correspond the respective heaters 25; in other words, the sensors 26 are arranged along three concentric imaginary circles b2, b3, and b4 having the common center c and different radiuses. Specifically, one of the sensors 26 is located at the common center c, which is used for four of the heaters 25 arranged along the smallest circle a1. Eight of the sensors 26, which are used for eight of the heaters 25 arranged along the circle a2, are arranged at equal intervals along the circle b2 whose radius is smaller than the circle a2 and larger than the circle a1. Twelve of the sensors 26, which are used for twelve of the heaters 25 arranged along the circle a3, are arranged at equal intervals along the circle b3 whose radius is smaller than the circle a3 and larger than the circle a2. Sixteen of the sensors 26, which are used for sixteen of the heaters 25 arranged along the circle a4, are arranged at equal intervals along the circle b4 whose radius is smaller than the circle a4 and larger than the circle a3.

Thus, each of the sensors 26 is located in the vicinity of a corresponding one or ones of the heaters 25, and detects the temperature(s) of the heater(s) 25 or its/their neighborhood(s), thereby generating a corresponding one of electrical detection signals $S_{H1}$ to $S_{H37}$. These signals $S_{H1}$ to $S_{H37}$ thus generated are then sent to a heater controller 31 explained below. As the sensors 26, any type of temperature sensor, such as a thermocouple and a thermistor, may be used if it can be located near the corresponding heater or heaters 25.

The polishing apparatus 1 according to the embodiment of the invention further comprises the heater controller 31, a temperature compensator 32, and a film-thickness measuring device 40, as shown in FIG. 2.

The heater controller 31 controls the operations (i.e., the heating temperatures) of the heaters 25 provided on the plate 23 of the holder 20.

The temperature compensator 32 is used for setting temperature compensation values in such a way that the polishing rate is approximately uniform over the whole polishing surface of the target film 3 of the substrate 2. The compensator 32 generates electrical temperature-compensation signals $S_{C1}$ to $S_{C37}$ and then, sends them to the heater controller 31. This is conducted according to the film-thickness data $D_T$ sent from the film-thickness measuring device 40, where the data $D_T$ denotes the thickness values of the target film 3 at the specific positions. Responsive to the temperature-compensation signals $S_{C1}$ to $S_{C37}$, the controller 31 adjusts the magnitudes of the electrical currents $I_{H1}$ to $I_{H40}$ supplied to the respective heaters 25 in such a way that the detection signals $S_{H1}$ to $S_{H37}$ are equal in value to the temperature-compensation signals $S_{C1}$ to $S_{C37}$ respectively.

The film-thickness measuring device 40 is used for measuring the thickness distribution of the target film 3 of the substrate 2 and for generating the film-thickness data $D_T$ based on the thickness distribution thus measured. Thereafter, the device 40 sends the film-thickness data $D_T$ to the compensator 32. The compensator 32 sets the compensation values for the respective heaters 25 based on the data $D_T$ in the following manner.

The film-thickness data $D_T$ contains measured values of the thickness of the target film 3 at the forty (40) measuring points corresponding to the forty (40) heaters 25. Here, if the initial thickness is $d_1$, the desired, final (i.e., post-polishing) thickness is $d_0$, the post-polishing, actually-measured thickness is $d_2$, the desired polishing rate is $R_0$, the actual polishing rate is R, and a polishing period is t, the following relationships (1) and (2) are established.

$$R_0=(d_1-d_0)/t \quad (1)$$

$$R=(d_1-d_2)t \quad (2)$$

From these equations (1) and (2), the polishing rate deviation ΔR, which is the deviation or difference of the actual polishing rate R with respect to the desired polishing rate $R_0$, is given by the following equation (3).

$$\Delta R=R-R_0=(d_0-d_2)/t \quad (3)$$

Thus, it is easily seen that the polishing rate deviation ΔR can be calculated from the post-polishing, actually-measured thickness $d_2$.

The temperature compensator 32 calculates the polishing rate deviation ΔR at the respective measuring points corresponding to the location or arrangement of the heaters 25. The data of the initial thickness $d_1$ is stored in advance in the compensator 32.

The temperature compensation data, i.e., the temperature compensation values for setting the values of the deviation ΔR at "0", are stored in advance in the compensator 32. These temperature compensation values are easily obtainable by a known experiment.

The compensator 32 sets the temperature compensation values that cancel the deviation ΔR at the respective measuring points. Thereafter, according to the temperature compensation values thus set, the compensator 32 generates the temperature compensation signals $S_{C1}$ to $S_{C37}$ and sends them to the heater controller 31.

As explained above, the single sensor 26 located at the center c of the plate 23 corresponds to the four heaters 25 arranged along the circle a1. Therefore, the compensation signal $S_{C1}$ for the sensor 26 in question is determined based on the average value of the four compensation values for the four heaters 25.

The compensator 32 having the above-described functions is realizable easily by software on an ordinary computer.

Figure 4:
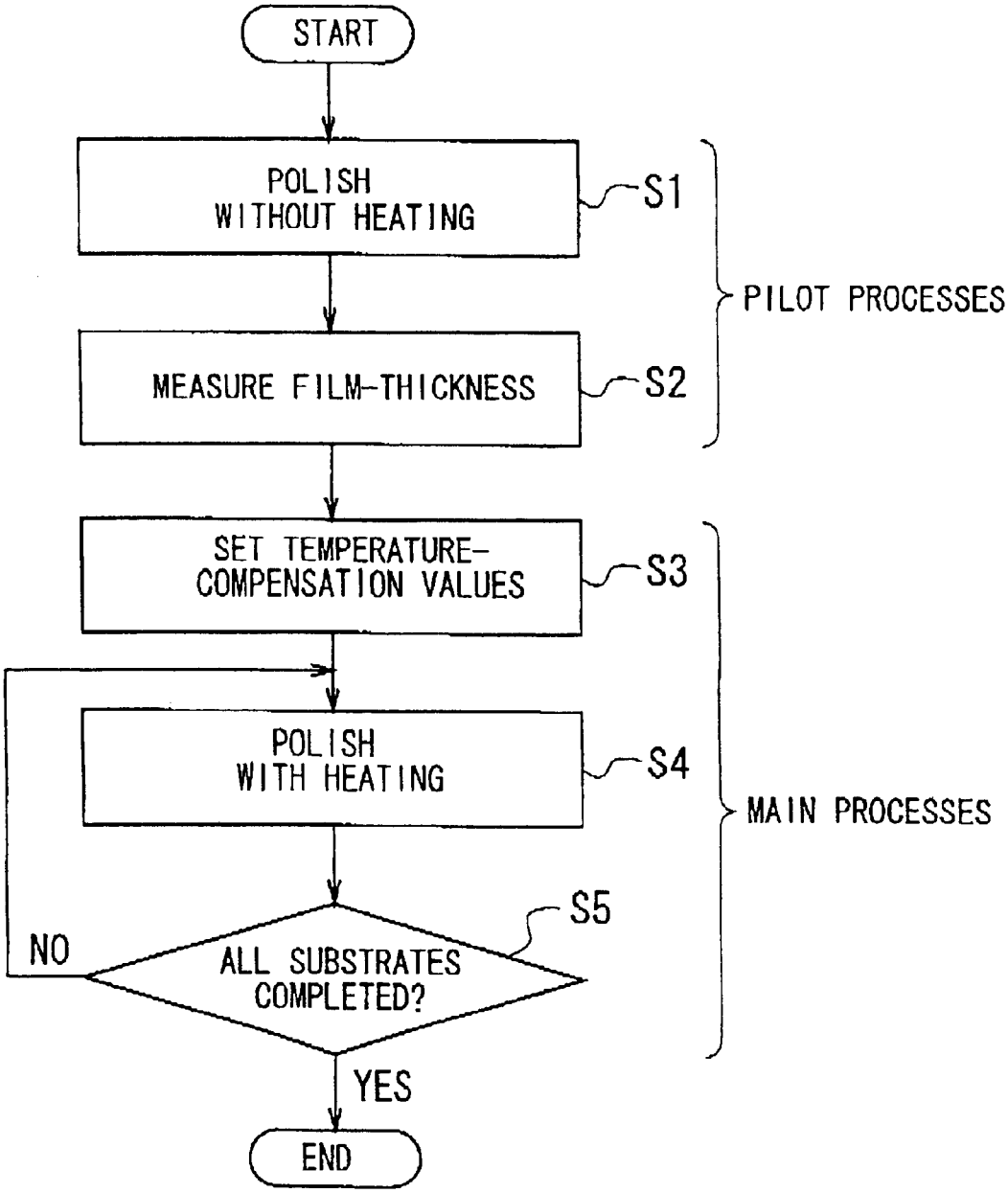
FIG. 4 is a flowchart showing the steps of a CMP method carried out using the polishing apparatus according to the embodiment of FIG. 2.

Next, the operation of the polishing apparatus 1 of FIG. 2 (i.e., a polishing method for CMP) is explained below with reference to FIG. 4.

First, the pilot processes comprising the steps S1 and S2 are carried out.

In the step S1, without heating the substrate 2 with the heaters 25, the target film 3 of the substrate 2 is polished. Specifically, the substrate 2 is held by the holder 20 and then, the polishing slurry 14 is supplied onto the polishing pad 12 in the form of drops by way of the slurry supply tube 13 while rotating the platen 11 in a horizontal plane. Due to the rotation of the platen 11, the slurry 14 supplied onto the pad 12 is affected by a centrifugal force and as a result, the slurry 14 is distributed uniformly on the surface of the pad 12. Thereafter, the holder 20 is moved downward to the pad 12 while rotating the holder 20 in the same direction as the rotating platen 11 until the target film 3 of the substrate 2 is attached to the surface of the pad 12 with a specific pressing force, as shown in FIG. 2. This state is kept for a specific polishing period, thereby polishing the film 3 for global planarization. In this state, the surface area of the target film 3 chemically reacts with potassium hydroxide (KOH) contained in the slurry 14, thereby forming a soft layer (not shown) on the film 3. The soft layer thus formed is mechanically polished with grains contained in the slurry 14. Thus, the CMP process advances. In this step S1, the operation of the heater controller 31 is stopped so as not to apply any heat to the substrate 2.

In the next step S2, the post-polishing thickness of the target film 3 is measured with the use of the film-thickness measuring device 40.

Figure 5:
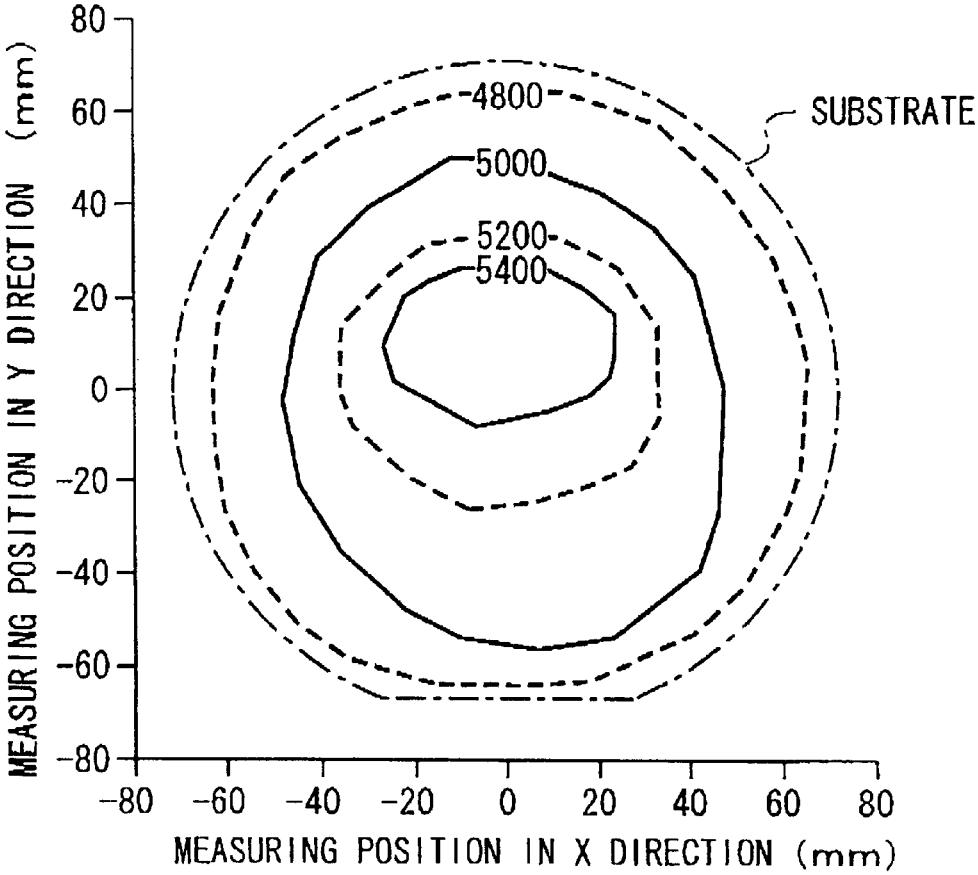
FIG. 5 is a graph showing the thickness distribution of the target film over the whole substrate, which is obtainable in the step S2 in FIG. 4.

FIG. 5 shows an example of the thickness distribution of the target film 3 obtained in the step S2, in which the thickness value is relatively small in the peripheral area of the substrate 2 and relatively large in its central area. This means that the polishing rate is relatively large in the peripheral area and relatively small in the central area on the substrate 2.

Subsequently, the main processes comprising the steps S3 to S5 are carried out.

In the step S3, the proper temperature compensation values are set based on the measurement result obtained in the step S2 Specifically, the temperature compensator 32 sets the temperature compensation values based on the film-thickness data $D_T$ sent from the film-thickness measuring device 40. Then, the compensator 32 generates the temperature compensation signals $S_{C1}$ to $S_{C37}$ corresponding to the temperature compensation values thus set.

For example, if the thickness distribution of FIG. 5 is obtained, the temperature compensation values are determined in such as way that the temperature is higher in the central area than that in the peripheral area.

In the step S4, while heating the substrate 2 with the heaters 25, the target film 3 of the substrate 2 is polished. Specifically, in the same way as the step S1, the substrate 2 is held by the holder 20 and then, the polishing slurry 14 is supplied onto the polishing pad 12 in the form of drops by way of the slurry supply tube 13 while rotating the platen 11 in a horizontal plane. Due to the rotation of the platen 11, the slurry 14 supplied onto the pad 12 is affected by a centrifugal force and as a result, the slurry 14 is distributed uniformly on the surface of the pad 12. Thereafter, the holder 20 is moved downward to the pad 12 while rotating the holder 20 in the same direction as the rotating platen 11 until the target film 3 of the substrate 2 is contacted with the surface of the pad 12 with a specific pressing force. This state is kept for a specific polishing period, thereby polishing the film 3. Within the entire polishing period, the substrate 2 is heated by the respective heaters 25 in such a way that the detection temperatures by the sensors 26 are respectively equal or proportional to the temperature compensation values.

In the final step 65, whether or not all the substrates 2 have been polished is judged. If the answer is "YES", the flow of the polishing processes is finished. If the answer is "NO", the flow is returned to the step S4 and the, the same steps S4 and S5 are repeated.

With the polishing apparatus 1 according to the embodiment of the invention, as explained above, the heaters 25 and the temperature sensors 26 are provided on the plate 23 in the substrate holder 20. The target film 3 of the substrate 2 is polished while heating the substrate 2 with the heaters 25.

The heating temperatures of the heaters 25 are detected by the sensors 26. The temperature compensator 32 sets the temperature compensation values for the respective heaters 25 based on the advance film-thickness data $D_T$. The temperature compensation values are set in such a way that the polishing rate deviation ΔR is zero, in other words, the polishing rate is substantially uniform over the whole polishing surface of the substrate 2. The heaters 25 are controlled by the heater controller 31 in such a way that the heating temperatures of the heaters 25 are respectively equal or proportional to the temperature compensation values.

Therefore, the polishing rate or speed can be uniformized substantially within the whole polishing surface of the substrate 2. Moreover, since the temperature compensation values are set based on the post-polishing thickness of the target film 3, the polishing rate uniformization is ensured.

Since the heaters 25 are controlled by the heater controller 31 while detecting their heating temperatures, the temperature compensation can be suppressed even if friction-inducing heat is generated within the polishing period. Thus, satisfactory or improved flatness is easily obtainable over the whole substrate 2.

VARIATIONS

Needless to say, the present invention is not limited to the above-described embodiment. Any change or modification may be added to it within the spirit of the invention.

For example, in the above-described embodiment, the count of the heaters is 25 and the count of the temperature sensors 26 is 37. However, the counts of the heaters 25 and the sensors 26 may be optionally set at any values. It is preferred that the counts of the heaters 25 and the sensors 26 are 30 or greater.

Instead of setting or determining the measuring points of the film thickness of the target film 3 corresponding to the arrangement of the heaters 25, the measuring points may be set corresponding to the arrangement of the sensors 26. In this case, the temperature compensation values are set in such a way that the polishing rate deviation ΔR is zero at the respective measuring points corresponding to the sensors 26.

Furthermore, on calculation of the deviation ΔR, the minimum value of the post-polishing measured values $d_2$ may be used instead of the desired thickness $d_0$. In this case, approximately the same advantages are obtainable.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A polishing apparatus for CMP, comprising:

a polishing platen rotatable around its axis, on which a polishing pad is placed on operation;

a substrate holder for holding a substrate to be polished, the holder being rotatable around its axis and the substrate having a target film to be polished;

heaters for heating the substrate held by the holder, the heaters being provided on the holder;

temperature sensors for detecting temperatures of the corresponding heaters;

temperature compensating means for setting temperature compensation values for the respective heaters in such a way that a polishing rate is approximately uniform over a whole polishing surface of the target film; and a controller for controlling the heaters in such a way that the temperatures detected by the temperature sensors correspond to the temperature compensation values;

wherein the substrate is heated by the heaters while controlling the heaters with the controller within a polishing period of the target film.

2. The apparatus according to claim 1, wherein the temperature compensating means sets the temperature compensation value based on post-polish thickness distribution of the target film.

3. The apparatus according to claim 1, wherein the heaters are arranged to cover the substrate.

4. The apparatus according to claim 3, wherein the heaters are located on imaginary concentric circles at regular intervals.

5. A polishing apparatus for CMP, comprising:

a polishing platen rotatable around its axis, on which a polishing pad is placed on operation;

a substrate holder for holding a substrate to be polished, the holder being rotatable around its axis and the substrate having a target film to be polished;

heating means for heating the substrate held by the holder;

temperature detecting means for detecting temperature of the heating means;

temperature compensating means for setting a temperature compensation value in such a way that a polishing rate is approximately uniform over a whole polishing surface of the target film; and a controller for controlling the heating means in such a way that the temperature detected by the temperature detecting means corresponds to the temperature compensation value;

wherein the substrate is heated by the heating means while controlling the heating means with the controller within a polishing period of the target film, and wherein the temperature detecting means comprises temperature sensors arranged to cover the substrate;

each of the sensors detecting a temperature of a corresponding one of the heaters.

6. The apparatus according to claim 5, wherein the sensors are located on imaginary concentric circles at regular intervals.

7. A polishing method for CMP, comprising:

providing a polishing platen rotatable around its axis, on which a polishing pad is placed on operation;

providing a substrate holder for holding a substrate to be polished, the holder being rotatable around its axis and the substrate having a target film to be polished;

setting temperature compensation values in such a way that a polishing rate is approximately uniform over a whole polishing surface of the target film of the substrate; and pressing the substrate held by the rotating holder against the rotating pad to polish the film while heating the substrate with heaters;

wherein the temperatures of the heaters are respectively detected by corresponding temperature sensors;

and wherein the heaters are controlled in such a way that the respective temperatures detected by the temperature sensors correspond to the temperature compensation values.

8. The method according to claim 7, wherein a post-polishing thickness of the target film is measured;

the temperature compensation value being determined based on the post-polishing thickness thus measured.

9. The method according to claim 7, wherein the heaters are arranged to cover the substrate.

10. The method according to claim 9, wherein the heaters are located on imaginary concentric circles at regular intervals.

11. A polishing method for CMP, comprising:

providing a polishing platen rotatable around its axis, on which a polishing pad is placed on operation;

providing a substrate holder for holding a substrate to be polished, the holder being rotatable around its axis and the substrate having a target film to be polished;

setting a temperature compensation value in such a way that a polishing rate is approximately uniform over a whole polishing surface of the target film of the substrate; and pressing the substrate held by the rotating holder against the rotating pad to polish the film while heating the substrate with heating means;

wherein the temperature of the heating means is detected by temperature detecting means;

wherein the heating means is controlled in such a way that the temperature detected by the temperature detecting means corresponds to the temperature compensation value, and wherein the temperature detecting means comprising temperature sensors arranged to cover the substrate;

each of the sensors detecting a temperature of a corresponding one of the heaters.

12. The method according to claim 11, wherein the sensors are located on imaginary concentric circles at regular intervals.

* * * * *